US006185811B1

(12) United States Patent
Perry

(10) Patent No.: US 6,185,811 B1
(45) Date of Patent: Feb. 13, 2001

(54) METHOD FOR MAKING A TRANSFORMER

(75) Inventor: Jeffrey E. Perry, Guelph (CA)

(73) Assignee: Hammond Manufacturing Company, Ontario (CA)

( * ) Notice: Under 35 U.S.C. 154(b), the term of this patent shall be extended for 0 days.

(21) Appl. No.: 09/024,459

(22) Filed: Feb. 17, 1998

Related U.S. Application Data

(63) Continuation of application No. 08/709,130, filed on Sep. 6, 1996, which is a continuation of application No. 08/283,584, filed on Aug. 1, 1994.

(51) Int. Cl.[7] ..... H01F 7/06

(52) U.S. Cl. ..... 29/606; 29/602.1; 29/603.04; 29/603.25; 336/55; 336/61; 336/96; 336/198; 336/205

(58) Field of Search ..... 29/606, 605, 602.1, 29/603.04, 603.23, 603.25; 336/55, 61, 96, 205, 198, 98

(56) References Cited

U.S. PATENT DOCUMENTS

| | | | | |
|---|---|---|---|---|
| 2,947,957 | * | 8/1960 | Spindler | 336/61 |
| 2,948,930 | * | 8/1960 | Herbst | 18/59 |
| 3,541,487 | * | 11/1970 | Leonard | 336/58 |
| 3,659,239 | * | 4/1972 | Marton | 336/57 X |
| 3,665,358 | * | 5/1972 | Leuck et al. | 336/96 X |
| 3,713,060 | * | 1/1973 | Harlow | 336/58 |
| 3,749,601 | * | 7/1973 | Tittle | 117/218 |
| 4,039,904 | * | 8/1977 | Klein et al. | 361/433 X |
| 4,081,776 | * | 3/1978 | Hisamoto et al. | 336/61 X |
| 4,119,555 | * | 10/1978 | Jay | 252/66 X |
| 4,752,999 | * | 6/1988 | Sill, Jr. | 29/605 X |
| 4,804,340 | | 2/1989 | Hamer et al. . | |
| 4,897,626 | * | 1/1990 | Fitter | 336/61 X |
| 5,008,643 | * | 4/1991 | Heritier-Best | 336/96 X |
| 5,157,368 | * | 10/1992 | Okano et al. | 336/90 |

FOREIGN PATENT DOCUMENTS

| | | | | |
|---|---|---|---|---|
| 893877 | * | 2/1972 | (CA) . | |
| 898921 | * | 4/1972 | (CA) . | |
| 3522740 | * | 10/1986 | (DE) | 336/198 |
| 562469 | * | 9/1993 | (EP) | 336/61 |
| 562469 A1 | * | 9/1993 | (DE) . | |
| 648697 | * | 1/1951 | (FR) . | |
| 63-50007 | * | 3/1988 | (JP) | 336/61 |
| 426249 | * | 10/1974 | (RU) | 336/61 |

* cited by examiner

*Primary Examiner*—Valencia Martin-Wallace
*Assistant Examiner*—Binh-An Nguyen
(74) *Attorney, Agent, or Firm*—Leydig, Voit & Mayer, Ltd.

(57) ABSTRACT

A transformer includes a core assembly having a coil, a core with at least a portion extending through the coil, and terminals for providing electrical connection with the transformer. The core assembly is impregnated with a thermally conductive material to form a unitary core mass. An outer coating which is also highly thermally conductive encapsulates the core mass. The outer coating includes a plurality of finned or ribbed surfaces that provide an increased heat transfer area to a surrounding cooling medium such as air.

16 Claims, 2 Drawing Sheets

METHOD FOR MAKING A TRANSFORMER

CROSS REFERENCE TO RELATED APPLICATIONS

This application is a continuation of application Ser. No. 08/709,130 filed Sep. 6, 1996, which is a file-wrapper-continuation of application Ser. No. 08/283,584 filed Aug. 1, 1994, the disclosures of which are herein incorporated by reference.

FIELD OF THE INVENTION

The present invention relates generally to the transformer art. More particularly, the present invention pertains to the art and science of transformer structures and methods for constructing those structures. Even more specifically, the present invention relates to a transformer with an impregnated core and coil assembly and a molded outer coating that encapsulates the core and coil assembly to provide improved performance characteristics, while reducing size and cost associated with prior designs.

BACKGROUND OF THE INVENTION

Heretofore, transformers in commercial settings half typically comprised a transformer core assembly having a primary and secondary windings coupled with a laminated iron core element, typically in an E-shaped configuration. During operation, essentially all of the energy dissipated in a conventional transformer appears as heat that is generated primarily by the transformer windings and core. Such heat increases the temperature of the windings and core, and thus, reduces the efficiency of the transformer. To operate the transformer in the safe temperature limit for the rated output capacity, the heat generated in the transformer in the form of losses must be carried away to the cooling medium which is air.

Prior attempts have been made in this field without adequately resolving the above-mentioned problems. For example, Spindler, U.S. Pat. No. 2,947,957, provides a transformer with spaced metallic cooling fins for thermally conducting heat generated by the core and coil. The cooling fins are secured to the core of the transformer via retaining screws. When the transformer is assembled, the entire assembly is dipped in a thermally conductive potting compound to increase the ruggedness and dissipation of heat from the windings. This design, however, is larger than conventional transformer designs with its protruding fins while not completely solving the problems associated with heat losses.

Other prior transformer designs have attempted to address the heat dissipation deficiencies generally associated with the prior art systems discussed above. One such attempt is found in Herbst, U.S. Pat. No. 2,948,930, for a heat conductive potting compound which is used to conduct heat from a transformer. This system, like the others discussed above, fails to satisfactorily overcome the operating deficiencies noted above, and further represents a somewhat bulky transformer design.

Still other designs have employed the use of a premolded shell that surrounds the internal components of the transformer. In particular, the shell is placed over the transformer coil and is glued to the transformer core. The shell is then filled with a liquid epoxy resin that is heated and cured. The premolded shell of these configurations, however, creates a heat dissipation interface that actually interferes with the heat transfer of the core and windings. Accordingly, these designs likewise fail to totally address the heat transfer requirements of the core and windings of the transfer.

SUMMARY OF THE INVENTION

Thus, the prior art transformer designs now offer unsatisfactory performance, at high cost with resulting efficiency losses from undue heat dissipation, particularly in a commercial setting. Accordingly, a principle object of the present invention is to generally overcome deficiencies of the prior art.

More particularly, it is an object of the present invention to provide a commercial quality transformer design that provides increased efficiency in operation.

It is another object of the present invention to provide a transformer design with improved heat transfer characteristics.

In addition, it is an object of the present invention to provide a transformer that is a compact design to address limited size requirements.

The present invention meets these and other additional objects through an improved transformer design. The invention improves the heat transfer from a source to a cooling medium such as the ambient by effectively conducting heat from the source to heat dissipating surfaces, and effectively increasing the heat dissipating surface area for a given volume. The present invention further provides a method for forming the same invention to achieve the desired result. Structurally, a preferred embodiment of the present invention comprises an inner coil and core assembly including a coil having a primary winding and a secondary winding, a core element with at least a portion extending through the coil, and terminals electrically coupled with the coil to provide access with the transformer. The core and coil assembly is impregnated with a material having a high thermal conductivity that bonds the components of the core assembly into a core mass.

An outer thermally conducting coating encapsulates the inner core mass to provide exterior heat transfer surfaces to the cooling media of air or liquid. The outer coating includes a plurality of molded fins for increasing the heat transfer area to the cooling medium thereby increasing the output rating of the transformer per unit size and the overall efficiency of operation. In this way, heat is transferred from the heat dissipating surfaces to a cooling media such as the ambient through radiation and conduction.

In another aspect of the present invention, a method for forming a transformer that includes a core assembly with a coil, a core element with a portion extending through the coil, and electrical terminals connected to the coil to provide electrical connection for the transformer. The method includes impregnating the core assembly with a material of high thermal conductivity to form a substantially unitary core mass. The impregnating step preferably uses vacuum pressure for removing moisture and other impurities from the core assembly such that the material fills the interstices of the core assembly. Thereafter, a thermally conductive coating is molded around the core assembly to encapsulate the core mass. Preferably, this molding step includes forming a plurality of finned surfaces proximate the coil of the inner core mass to provide improved heat transfer from the coil. Additional features and embodiments are described below.

BRIEF DESCRIPTION OF THE DRAWINGS

The above described and additional objects and features of the present invention may be further understood by reference to the following detailed description of a preferred embodiment taken in conjunction with the accompanying drawings of which.

DETAILED DESCRIPTION OF THE PREFERRED EMBODIMENT

Generally, the present invention provides an improved transformer design having an inner coil and core assembly that is impregnated with a thermally conductive material to form an inner mass. This mass is encapsulated by an outer thermoplastic coating that also has a high thermal conductivity to provide improved heat transfer from the inner mass to the exterior of the outer coating. Preferably, the outer coating includes a plurality of ribbed or finned surfaces located proximate the transformer coil to increase the heat transfer area with the surrounding air or liquid. In accordance with the present invention, the inner coil and core assembly is in heat transfer relation with the outer coating to provide uniform heat dissipation in a compact transformer design, while providing greater efficiency during operation.

The intended use for the transformer design of the present invention is in the construction of control, distribution and power transformers in single and three phase configurations sized from 5 VA to 25,000 kVA. The teachings of this invention, however, may be employed in the construction of other transformer types and ratings.

Figure 1:
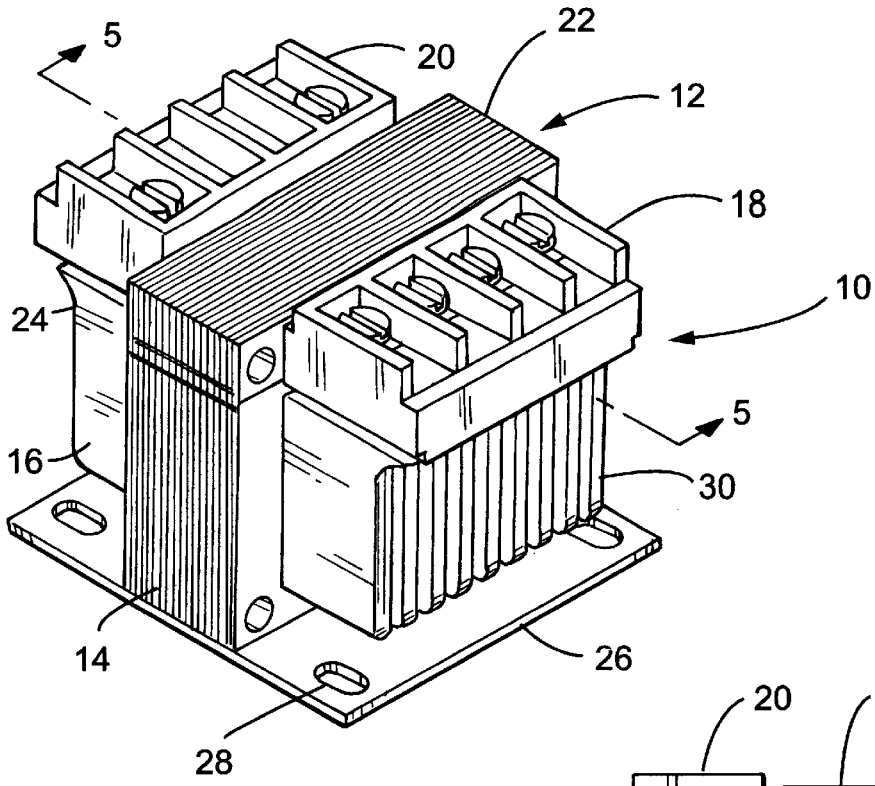
FIG. 1 is an isometric view of a molded transformer with an impregnated core assembly and molded covering according to the preferred embodiment of the present invention.
Figure 2:
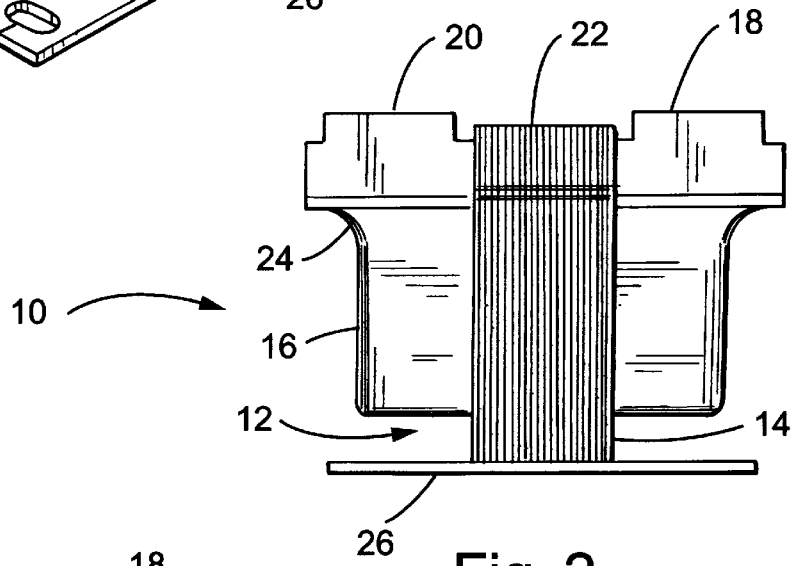
FIG. 2 is an end view of the transformer of FIG. 1.
Figure 3:
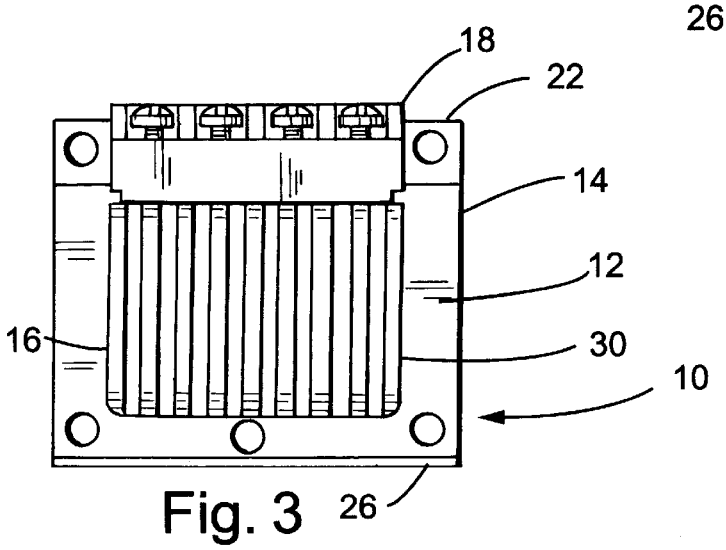
FIG. 3 is a side view the transformer of FIG. 1.
Figure 4:
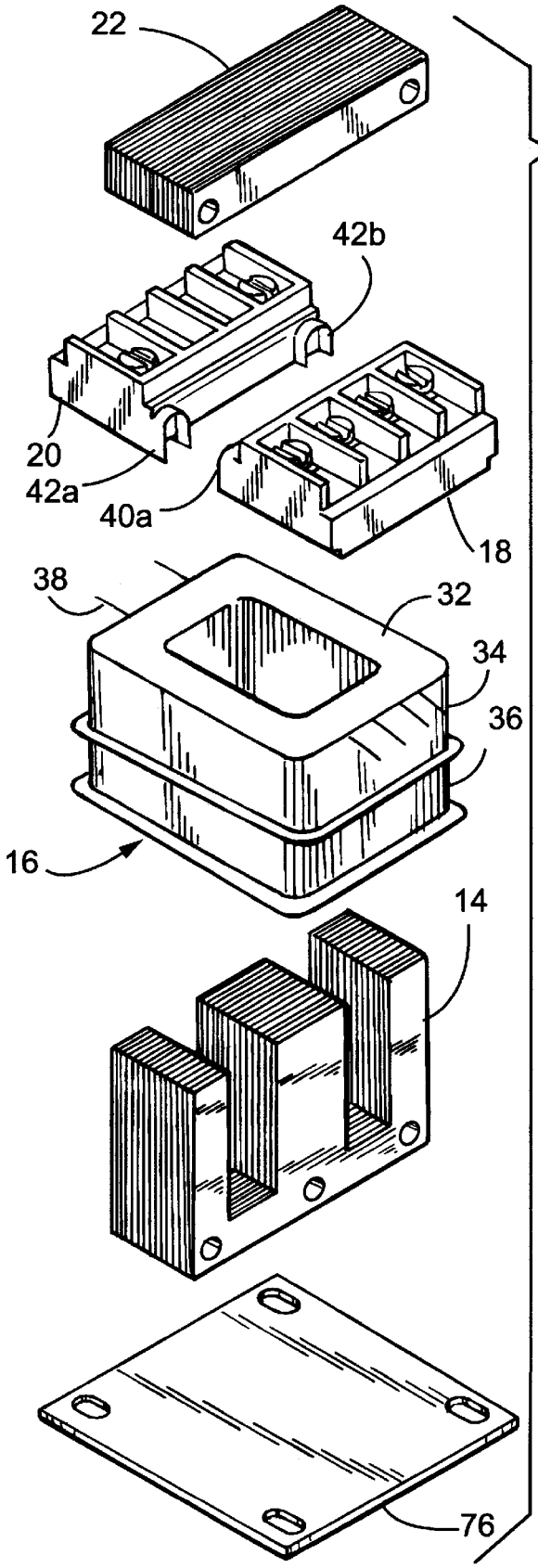
FIG. 4 is an exploded view of the core assembly of the molded transformer of FIG. 1.

Referring now jointly to FIGS. 1 through 3, therein is shown a molded transformer 10 according to the present invention. The molded transformer 10 includes an inner coil and core assembly 12 that includes a core element 14, a transformer coil 16, opposed terminal blocks 18 and 20, and a cover piece 22. The components of the inner coil and core assembly 12 are best shown in FIG. 4. This inner coil and core assembly 12 is first impregnated with a thermally conductive material to form an inner coil and core mass and then encapsulated within an outer coating 24 to provide improved heat transfer from the inner coil and core mass to the ambient. The inner coil and core assembly 12 is supported by a base plate 26 that subtends the coil and core mass. Preferably, the base plate 26 includes one or more apertures such as aperture 28 to provide ready access for securing the transformer.

The opposed plastic terminal blocks 18 and 20 are of substantially identical configuration. The terminal blocks 18 and 20 are electrically coupled with the windings of the transformer, as described in greater detail below, and provide easy access for electrical termination of the transformer. The structure and function of the terminal blocks shown in FIGS. 1–3 are described in greater detail in U.S. Pat. No. 4,804,340, incorporated herein by reference in its entirety.

As best seen in FIGS. 1 and 3, the outer coating is preferably formed with a plurality of equispaced, finned or ribbed surfaces 30 extending longitudinally from the opposed terminal blocks 18 and 20 substantially the height of the transformer coil 16. Inasmuch as the coating 24 is in heat transfer contacting relation with the core and coil mass so the ribbed surfaces 30 are proximate the windings of the coil they provide an increased heat transfer area for improved dissipation from the coil 16.

The main structural components of the coil and core assembly 12 are best seen in FIG. 4. As shown therein, the assembly includes the base plate 26, the core element 14, the transformer coil 16, the terminal blocks 18 and 20, and a cover piece 22. The base plate 26 supports the core element 14, which has a plurality of spaced iron laminations in a generally E-shaped configuration. The core element 14 has its legs extending upwardly from the base plate 16.

The transformer coil 16 typically includes a primary winding 34 and a secondary winding 36 wound around a bobbin 32. The windings 34 and 36 include a plurality of exposed leads such as lead 38 that are electrically coupled with appropriate connections of the terminal blocks 18 and 20 as will be understood by those skilled in the art. The transformer coil 16 has its windings 34 and 36 magnetically coupled by interfitting within the E-shaped core element 14 so that the central leg of the core element protrudes through the transformer coil 16 while the outer legs of the core element flank the transformer coil 16. The coil 16 may be seated on (not shown) opposed skirt pieces located on the core element 14 as will be understood by those skilled in the art. Likewise, the transformer coil 16 may include spacer elements (not shown) located at the interior corners of the coil to prevent contact of the interior corners with the center leg of the E-shaped core element 14. Additionally, the transformer coil may include an insulation surrounding at least a portion of the windings. However, the most preferred manner of assembly is shown in FIG. 4 which eliminates various support pieces for the transformer coil 16 while maintaining its structural integrity. This arrangement provides more even heat transfer from the transformer coil, while reducing the overall size and weight of the transformer.

The terminal blocks 18 and 20 each include generally U-shaped skirt portions 40*a*, 40*b* and 42*a*, 42*b* which are sized to form channels to receive the top of the transformer coil 16. The top piece 22 sandwiches the opposed terminal blocks 18 and 20 and also the coil 16 in place. As described in further detail below, this assembly is impregnated with a highly thermally conductive material to form a unitary core mass that provides uniform heat transfer of coil and core assembly during operation.

The transformer design of the present invention is readily constructed. The components of the coil and core assembly 12 shown in FIG. 4 are first assembled. In particular, the transformer coil windings are wound around the bobbin 32 in a manner known to those skilled in the art. The transformer coil 16 is then seated within the E-shaped core element 14 so that the center leg of the E protrudes through the coil 16 and the outer legs flank the coil. The opposed terminal blocks 18 and 20 are thereafter located on the transformer coil 16 with the appropriate electrical connections made with the exposed leads of the windings. The cover piece 22 is thereafter affixed to the core element 14 to secure the terminal blocks 18 and 20 and the transformer coil 16 in place. In a next step, the core element 14 is welded or otherwise secured to the base plate 24.

This assembly is thereafter impregnated with a highly thermally conductive material such as a finely ground silica flour. By way of example, a resin such as Part No. 468-2-7, manufactured by Ripley Resin Company or other suitable filled epoxy impregnation material may be utilized. Alternatively, a polyester material such as 50VT-30 manufactured by P. D. George may be used to impregnate the coil and core assembly. Preferably, the impregnated material is a low viscosity, highly thermally conductive material that has high dielectric strength. This material provides a thermally conductive path from the heat source (i.e. coil and core) to the heat dissipating surfaces.

The material is deposited within the core and coil assembly via vacuum/pressure impregnation. Thus, the moisture and other contaminants contained within the transformer coil are removed during impregnation. The material is forced within and substantially penetrates the coil and core assembly to substantially fill the interstices of the windings of the coil 16 as well as the spacings between the laminations of the core element 14. In this way, vacuum pressure impregnated material bonds the individual winding turns of the transformer coil 16 to adjacent turns. Likewise, the individual laminations of the core element 14 are bonded together to form a solid heat conductive mass that provides a heat sink for the transformer coil. Thus, the impregnation material forms a thermally conductive path by bridging the conductor turns of the windings 34 and 36 and providing a substantially uniform thermally conductive path from the inner windings to the outside edges of the coil.

Upon completion of the impregnation step, the transformer core element 14 and the coil 16 each have their respective laminations and windings bonded or bridged together. Likewise, the core element and the coil are bridged together where they are proximate or in contacting relation. Accordingly, a substantially monolithic or unitary inner core mass is formed which is comprised of the core element 14, the transformer coil 16, terminal blocks 18 and 20 and cover piece 22, bonded together by the thermally conductive material upon completion of impregnation. Accordingly, a highly effective thermal path is provided for heat generated by the transformer coil 16 via the core element 14 and the base plate 24.

Figure 5:
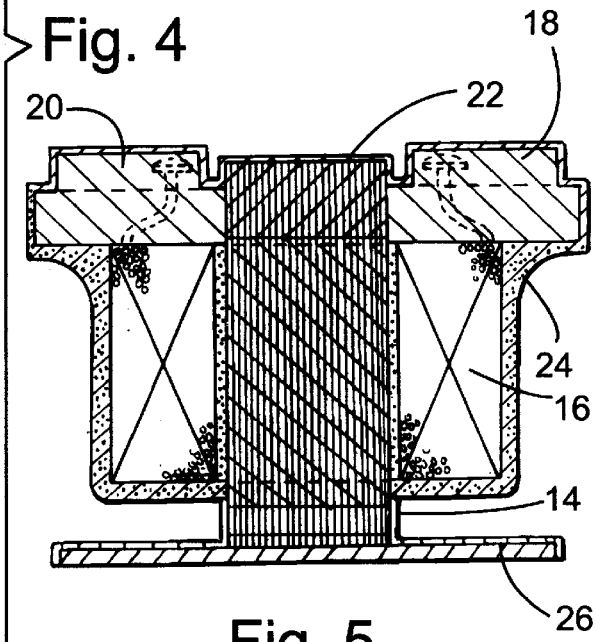
FIG. 5 is a cross-sectional view through the molded transformer taken along the lines 5—5 of FIG. 1.
Figure 6:
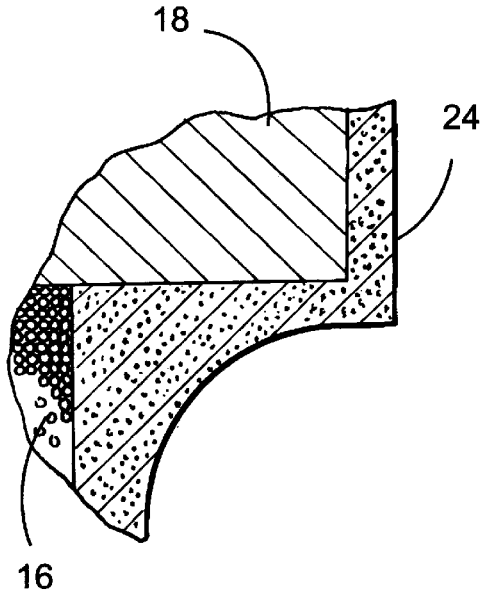
FIG. 6 is an enlarged fragmentary of the sectional view of FIG. 5.

Thereafter, the impregnated coil and core mass is molded in the moulding material or coating 24 as shown in FIGS. 5 and 6. This moulding material has properties of high thermal conductivity and high dielectric strength. By way of example, RYNITE®, a thermoplastic polyester blended with thermal conductive fillers and manufactured by E. I. du Pont de Nemours & Co. is one suitable material for encapsulating the coil and core mass. The heat generated by the transformer coil 16 is likewise transferred from the outside edge of each winding layer through the coating 24 to the outside surface of the coating. The coating is formed with a plurality of equispaced ribbed or finned surfaces 30 (see FIGS. 1 and 3) that extend longitudinally proximate the outer edge of the coil 16. The arrangement greatly increases the surface area by which transformer coil heat is conducted to surrounding air or liquid. The outer coating 24 also provides structural integrity for the coil and core assembly, while encapsulating the electrical components of the assembly.

While this arrangement provides a greater thermally conductive surface between the transformer coil and surrounding air, the coating 24 also provides coil protection from moisture, atmospheric contamination or other environmental degradation. In addition, the coating 18 provides resistance to mechanical and physical stresses. At the same time, a reduction in waste material is realized in the injection molding of the outer coating. This is, where prior transformer designs have utilized the pouring of epoxy materials into a shell that is later heated and then cured, the present invention provides a completely molded piece without any cleanup or waste material.

As set forth above, an improved transformer assembly and method of making the same has been described. Various modifications as would be apparent to one of ordinary skilled in the art and familiar with the teachings of this application are deemed to be within the scope of this invention. The precise scope of the invention is set forth in the appended claims, which are made, by reference, a part of this disclosure.

Various advantages flow readily from the disclosed transformer design and the corresponding method of manufacture. For example, an improved heat transfer path is provided between adjacent individual coil windings of transformer coil 16 and the transformer core element 14, as well as between the transformer coil 16 and the outer covering 24. This results in both a more uniform heat transfer and additional heat transfer surface area to the surrounding air or liquid. Accordingly, a dramatic increase in efficiency per unit size of the transformer may be achieved.

Accordingly, both the structure and the method of making of the present invention provide significant improvement over the prior art, improvements that are manifested in both increased performance and diminished size.

What is claimed is:

1. A method for making a transformer including a core assembly comprising a coil, an E-shaped core element with its midportion extending through the coil, aid an electrical terminal coupled with the coil, the method comprising:

impregnating the core assembly with a thermally conductive material to form a monolithic core mass in which the core and the coil are bonded; and then forming an outer coating, having a plurality of exposed finned surfaces, that surrounds the core mass by depositing a thermally conductive material directly upon the core mass to provide an exterior heat transfer surface for the core mass.

2. The method as recited in claim 1, wherein the step of impregnating the core assembly further comprises the step of using a resin compound to form the core mass.

3. The method as recited in claim 2, wherein the resin compound comprises finely ground silica flour.

4. The method as recited in claim 1, wherein the step of impregnating the core assembly further comprises the step of using a polyester material to form the core mass.

5. The method as recited in claim 1, wherein the step of impregnating the core assembly further comprises the step of using a low viscosity material having a high dielectric strength to form the core mass.

6. The method as recited in claim 1, wherein the step of impregnating the core assembly further comprises the step of forming the core mass using vacuum/pressure impregnation.

7. The method as recited in claim 1, wherein the step of forming the outer coating further comprises the step of using a thermoplastic polyester blended with thermal conductive fillers to form the outer coating.

8. The method as recited in claim 1, wherein the step of forming the outer coating further comprises the step of arranging the plurality of exposed finned surfaces such that they are equispaced.

9. A method for making a transformer, the method comprising:

forming a core assembly by performing the steps of:

winding a plurality of coils around a bobbin to form a coil element having a plurality of interstices; and seating the coil element within an E-shaped core element comprised of a plurality of spaced iron laminations such that the center leg of the E-shaped core element protrudes through the coil element and the outer legs of the E-shaped core element flank opposed sides of the coil element;

impregnating the core assembly with a thermally conductive material to form a monolithic core mass in which the E-shaped core element and the coil element are bonded and wherein the interstices of the coil element and the spacing between the laminations of the core element are substantially filled with the thermally conductive material; and then forming an outer coating, having a plurality of exposed finned surfaces, that surrounds the core mass by depositing a thermally conductive material directly upon the core mass to provide an exterior heat transfer surface for the core mass.

10. The method as recited in claim 9, wherein the step of impregnating the core assembly further comprises the step of using a resin compound to form the core mass.

11. The method as recited in claim 10, wherein the resin compound comprises finely ground silica flour.

12. The method as recited in claim 9, wherein the step of impregnating the core assembly further comprises the step of using a polyester material to form the core mass.

13. The method as recited in claim 9, wherein the step of impregnating the core assembly further comprises the step of using a low viscosity material having a high dielectric strength to form the core mass.

14. The method as recited in claim 9, wherein the step of impregnating the core assembly further comprises the step of forming the core mass using vacuum/pressure impregnation.

15. The method as recited in claim 9, wherein the step of forming the outer coating further comprises the step of using a thermoplastic polyester blended with thermal conductive fillers to form the outer coating.

16. The method as recited in claim 9, wherein the step of forming the outer coating further comprises the step of arranging the plurality of exposed finned surfaces such that they are equispaced.

* * * * *